US008443517B2

(12) United States Patent
Curtis

(10) Patent No.: US 8,443,517 B2
(45) Date of Patent: May 21, 2013

(54) EXPANSION JOINT BRACKET AND METHOD

(76) Inventor: Theodore Conrad Curtis, Saratoga, CA (US)

( * ) Notice: Subject to any disclaimer, the term of this patent is extended or adjusted under 35 U.S.C. 154(b) by 0 days.

(21) Appl. No.: 13/348,631

(22) Filed: Jan. 11, 2012

(65) Prior Publication Data

US 2012/0177435 A1 Jul. 12, 2012

Related U.S. Application Data

(60) Provisional application No. 61/431,739, filed on Jan. 11, 2011.

(51) Int. Cl.
*B21D 47/00* (2006.01)
*E04B 1/68* (2006.01)

(52) U.S. Cl.
USPC ..... 29/897.3; 29/897; 29/525.01; 52/396.02; 52/396.05; 248/309.1; 404/68

(58) Field of Classification Search
USPC ... 29/525.01, 897, 897.3; 14/73.5; 52/396.02, 52/396.05, 402, 848; 248/207, 309.1, 310, 248/314; 403/28; 404/68, 70
See application file for complete search history.

(56) References Cited

U.S. PATENT DOCUMENTS

| | | | | |
|---|---|---|---|---|
| 1,298,018 | A * | 3/1919 | Davis | 404/68 |
| 3,395,507 | A * | 8/1968 | Moody | 52/390 |
| 3,906,692 | A * | 9/1975 | Boiardi | 52/318 |
| 4,815,886 | A * | 3/1989 | Madsen | 403/28 |
| 6,293,066 | B1 * | 9/2001 | Lohrey | 52/396.08 |
| 6,598,364 | B1 * | 7/2003 | Pelles | 52/396.02 |
| 7,506,480 | B1 * | 3/2009 | Chandler | 52/393 |
| 2008/0263981 | A1 * | 10/2008 | O'Brien | 52/396.02 |

* cited by examiner

*Primary Examiner* — Alexander P Taousakis
(74) *Attorney, Agent, or Firm* — Hamilton, Brook, Smith & Reynolds, P.C.

(57) ABSTRACT

An expansion joint bracket retains an expansion joint board in a concrete installation. The expansion joint bracket may include a base member having multiple nail holes for securing the bracket to the earth (or sand or gravel put down prior to pouring concrete there upon). First and second board support members may run perpendicular to the base and parallel to each other to hold the expansion joint board in place. Gussets, typically triangular shaped gussets, extend from the board support members to the base member. The expansion joint brackets may be disposed every 12-24 inches on the expansion joint board and concrete may be poured over the expansion joint brackets, resulting in a quick and simple concrete installation.

2 Claims, 4 Drawing Sheets

EXPANSION JOINT BRACKET AND METHOD

CROSS-REFERENCE TO RELATED APPLICATIONS

This application claims the benefit of priority of U.S. provisional patent application No. 61/431,739, filed Jan. 11, 2011, the contents of which are herein incorporated by reference.

BACKGROUND OF THE INVENTION

The present invention relates to construction materials and, more particularly, to an expansion joint board holder.

Putting expansion joints in while pouring concrete is a timely and labor intensive process that involves lots of man hours and expendable material, such as wood and nails. Then, after concrete is poured, the laborers have to then go back and strip all of the expendable materials. This current system, while it may work adequately, it is labor intensive, time consuming and costly.

As can be seen, there is a need for an apparatus for putting an expansion joint while pouring concrete that may be quick, simple, and inexpensive.

SUMMARY OF THE INVENTION

In one aspect of the present invention, an expansion joint bracket comprises a base member; a nail hole on each end of the base member; first and second vertical support pieces; a first gusset running from the base member to the first vertical support piece; and a second gusset running from the base member to the second vertical support piece, wherein the first vertical support piece and the second vertical support piece form a channel adapted to receive an expansion joint board.

In another aspect of the present invention, a method for securing an expansion joint board comprises placing a plurality of expansion joint brackets along an area where the expansion joint board is to be placed, the expansion joint brackets comprising a base member; a nail hole on each end of the base member; first and second vertical support pieces; a first gusset running from the base member to the first vertical support piece; and a second gusset running from the base member to the second vertical support piece, wherein the first vertical support piece and the second vertical support piece form a channel adapted to receive an expansion joint board; securing a nail through each nail hole of the base member; placing the expansion joint board in position in the channels formed between the first and second vertical pieces of the plurality of expansion joint brackets; and optionally securing the expansion joint board to the expansion joint brackets with nails disposed through nail holes in each of the vertical support pieces.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an expansion joint bracket for retaining an expansion joint board in a concrete installation. The expansion joint bracket may include a base member having multiple nail holes for securing the bracket to the earth (or sand or gravel put down prior to pouring concrete there upon). First and second board support members may run perpendicular to the base and parallel to each other to hold the expansion joint board in place. Gussets, typically triangular shaped gussets, extend from the board support members to the base member. The expansion joint brackets may be disposed every 12-24 inches on the expansion joint board and concrete may be poured over the expansion joint brackets, resulting in a quick and simple concrete installation.

Figure 1:
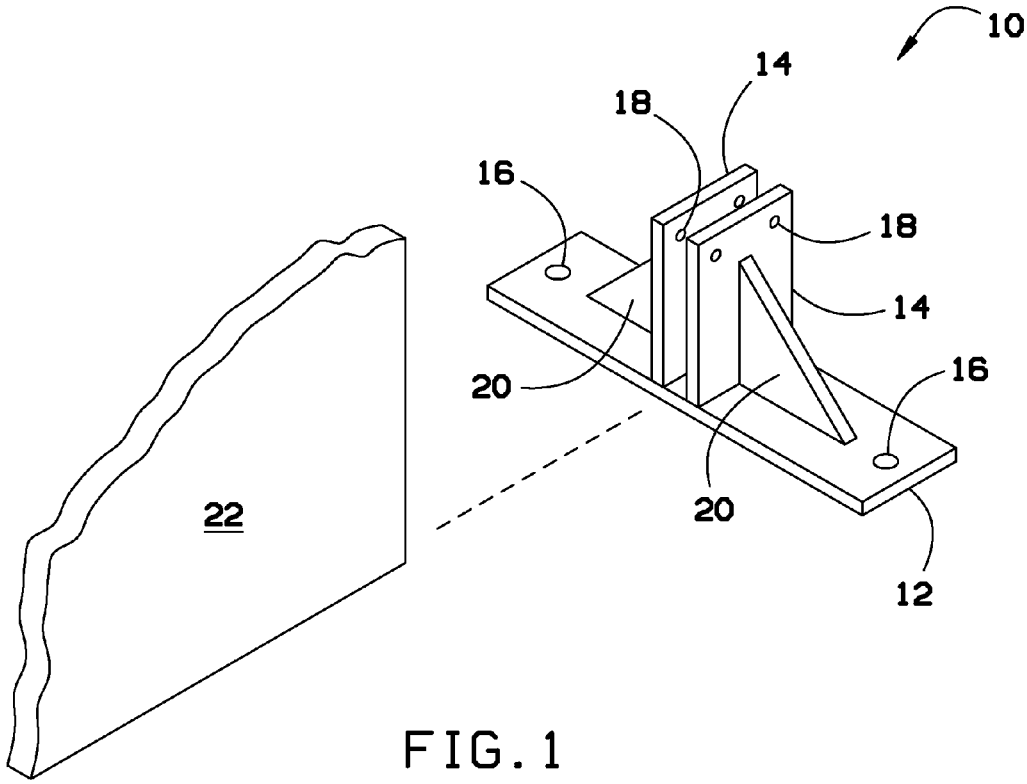
FIG. 1 is a perspective view of an expansion joint bracket according to an exemplary embodiment of the present invention.
Figure 2:
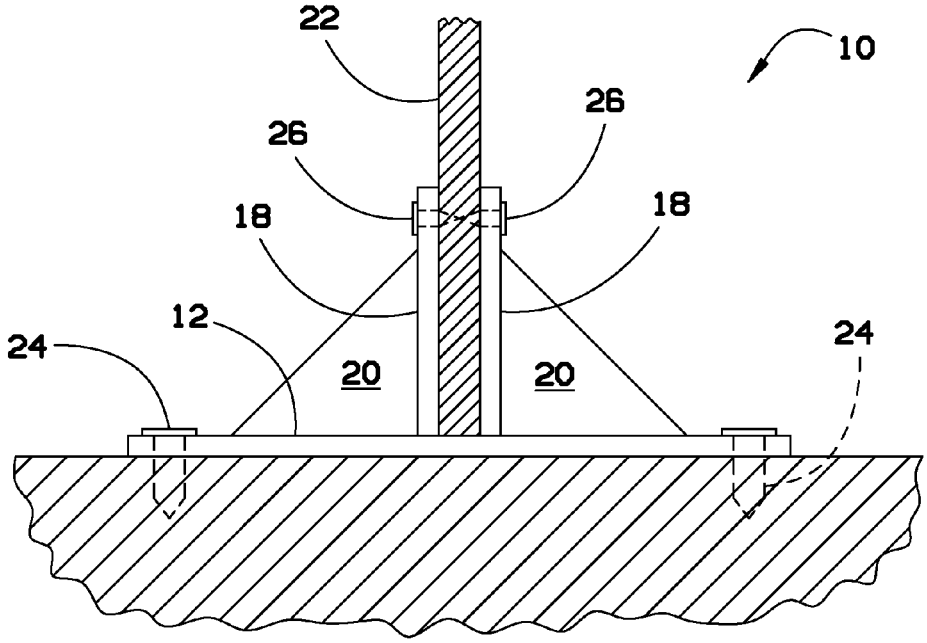
FIG. 2 is a side view of the expansion joint bracket of FIG. 1 installed to an expansion joint board, prior to pouring concrete.
Figure 3:
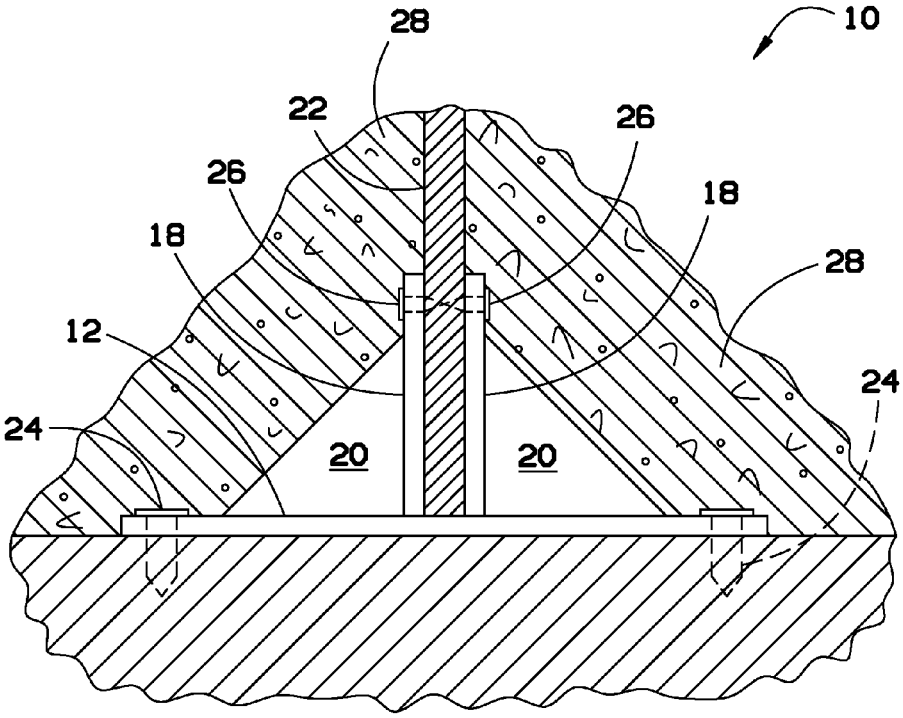
FIG. 3 is a side view of the expansion joint bracket of FIG. 1 installed to an expansion joint board, with concrete poured thereover.

Referring now to FIGS. 1 through 3, an expansion joint bracket 10 may include a base plate 12 that is between about 1 and 3 inches wide, typically about 2 inches and that is between about 4 and 12 inches long, typically about 8 inches. The base plate 12 may be between 1/16 and 1/2 inches thick, typically 1/4 inch. A nail hole 16 may be disposed on each end of the base plate 12 and may be adapted to receive a base nail 24. The nail hole 16 may be between 1/4 and 1/2 inches, typically 3/8 of an inch in diameter. Each nail hole 16 may be set between 1/8 and 3/4 of an inch from the end of the base plate 12, typically 1/4 of an inch.

First and second vertical supports 14 may be between 1/8 to 1/2 inch, typically 1/4 inch thick, from about 1 to 3 inches wide, typically about 2 inches wide, and from about 2 to 4 inches tall, typically about 3 inches tall. The supports 14 may sit in the center of the base with a 1/4 inch to a 3/4 inch, typically a 1/2 space/gap between them that runs perpendicular to the longer side of the base plate 12. The space/gap may be adapted to secure an expansion joint board 22 therewithin. Each vertical support 14 may have two nail holes 18, adapted to receive a board nail 26, that are between 1/16 and 7/16 inches, typically 5/16 of an inch in diameter. The nail holes 18 may be located on an end of the support 14 that is opposite an end attached to the base plate 12. The nail holes 18 may be between 1/8 and 1/2 inch from the edge of the supports 14 and may be separated between 1/8 and 2 inches. Typically, one nail hole 18 may be disposed near each of the two corners of the supports 14.

Two triangular gussets 20 may support each of the vertical supports 14. The triangular gusset 20 may be about 1/8 to 3 inches wide, typically about ¼ inch thick. The triangular gusset 20 may sit against each vertical support 14 as well as against the base plate 12, supporting each vertical support 14. The triangle gusset 20 typically stops short of the nail holes 16, 18 both on the base plate 12 and the vertical support 14, but can be smaller if desired. The two shorter edges of the triangle gusset 20 may be between 1 and 8 inches long, typically about 2.5 inches long. The longer edge of the triangle gusset 20 may be between 1 and 12 inches long, typically about 3.5 inches long. The gussets 20 may help support the expansion joint board 22 and keep it from being pushed over by the pressure of the poured concrete.

The expansion joint bracket 10 may be formed as an integral unit and may be made out of high density plastic. In some embodiments, the expansion joint bracket 10 may be made out of wood, different types of metals or hybrid materials.

Figure 5:
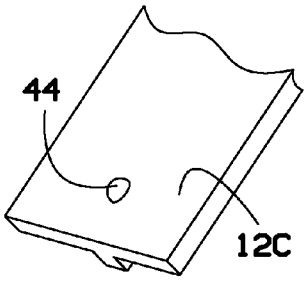
FIG. 5 is a close-up perspective view showing an engagement member of the expansion joint bracket of FIG. 4.
Figure 4:
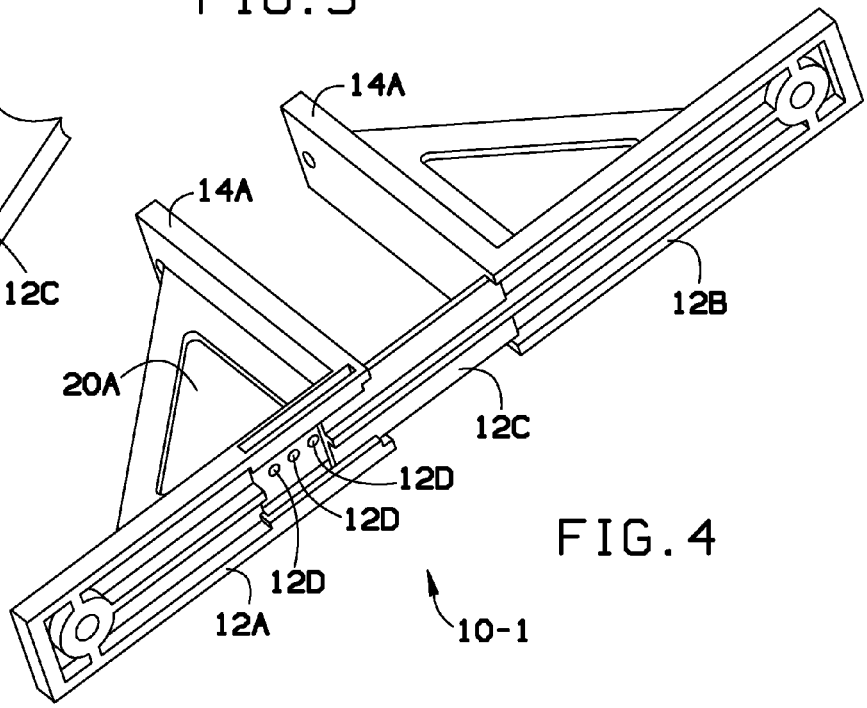
FIG. 4 is a perspective view of an expansion joint bracket having an adjustable gap, according to an exemplary embodiment of the present invention.

Referring now to FIGS. 4 and 5, an expansion joint bracket 10-1 may include first and second base members 12A, 12B that may slidably engage to vary the size of a gap between vertical supports 14A. The expansion joint bracket 10-1 of FIGS. 4 and 5 may be similar to that of FIGS. 1-3, for example, gussets 20A may connect the vertical supports 14A with the base members 12A, 12B.

The base members 12A, 12B may interconnect in various manners. For example, one of the base members 12A may be a female base member and the other base member 12B may be a male base member. The male base member 12B may have a tongue 12C fitting into a groove of the female base member 12A. The tongue may have a protrusion 44 that may align with one of several indents 12D in the female base member 12A. The protrusion 44 and indents 12D may be adapted to provide a space between the vertical supports 14A that fits standard expansion joint boards. For example, the space between the vertical supports 14A may be set at ⅜ inch by placing the protrusion 44 into one indent 12D, may be set at ½ inch by placing the protrusion 44 into a different indent 12D, may be set at ¾ inch by placing the protrusion 44 into another indent 12D, and the like.

Figure 6:
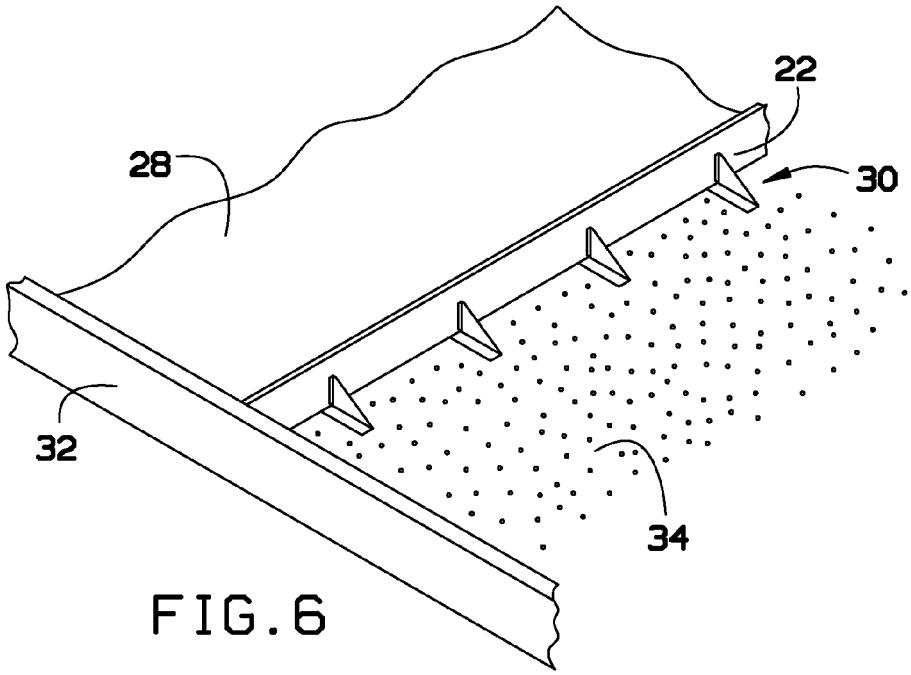
FIG. 6 is a perspective view of an expansion joint bracket according to another exemplary embodiment of the present invention installed in a concrete installation.
Figure 7:
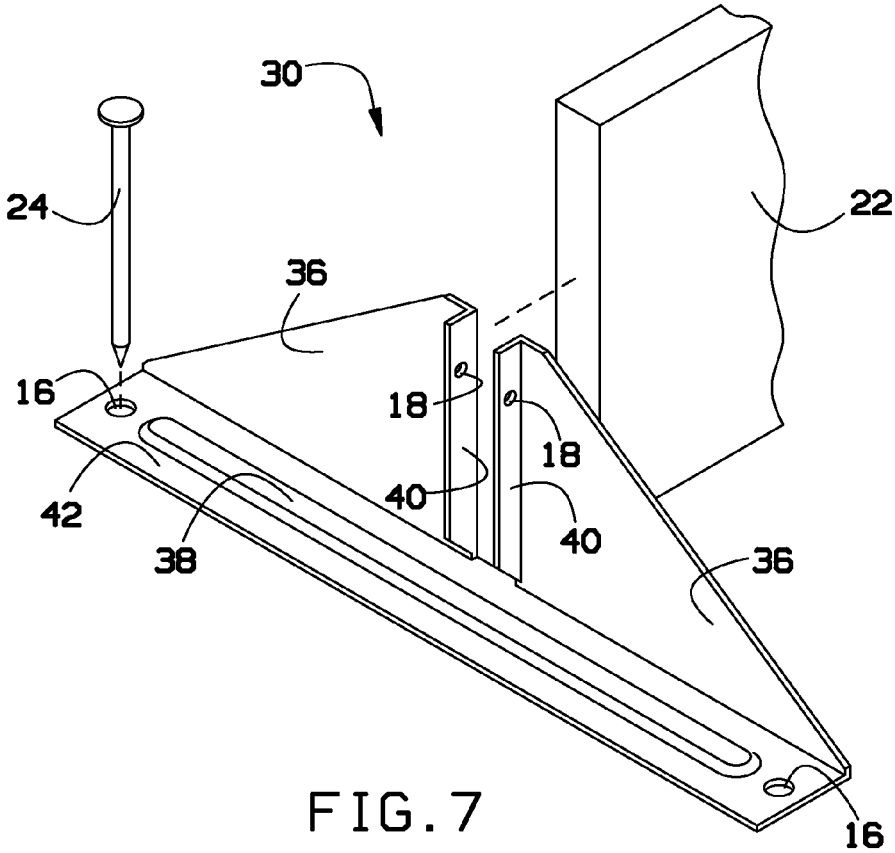
FIG. 7 is a perspective view of the expansion joint bracket of FIG. 6.
Figure 8:
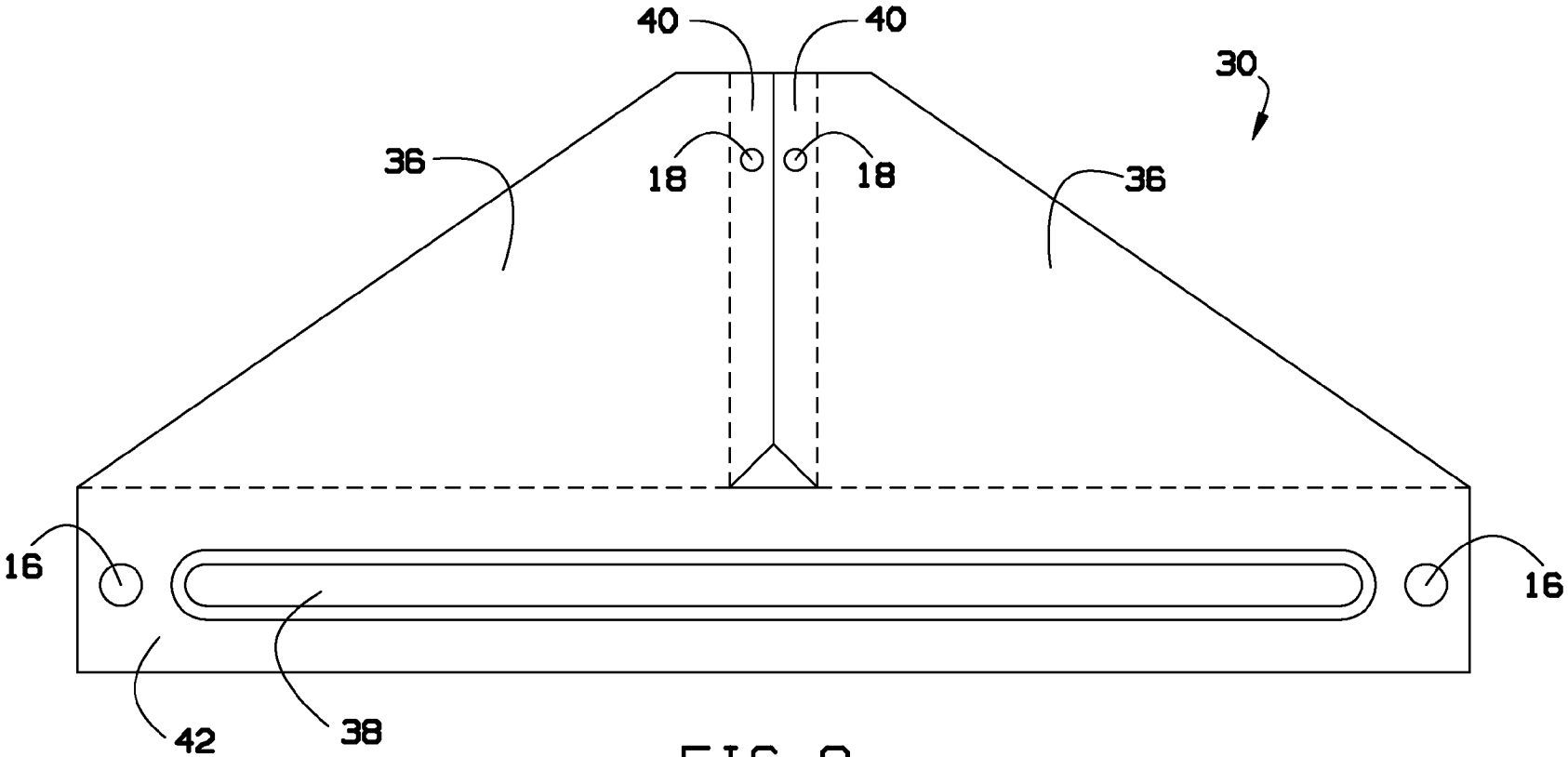
FIG. 8 is a side view of the expansion joint bracket of FIG. 6.

Referring now to FIGS. 6 through 8, an expansion joint bracket 30 may include a base 42 having nail holes 16, similar to the base 12 described above. The base 42 may optionally include a support rib 38 to provide structural support to the base 42.

Gussets 36 may extend from the base 42 and connect with vertical supports 40. Similar to the vertical supports 14 described above, the vertical supports 40 may include nail holes 18 therethrough. Typically, the vertical supports 40 may include a single nail hole 18 on each support 40. The vertical supports 40 may have a space/gap therebetween to hold the expansion joint board 22.

In some embodiments, the expansion joint bracket 30 may be made from a single piece of metal, such as steel, having 90 degree bends as shown by dashed lines in FIG. 8. In other embodiments, the expansion joint bracket 30 may be made from other materials, such as plastic, wood, composite or the like.

The expansion joint brackets 10, 30 may be provided as a single unit, or multiple brackets may be interconnected with a connecting member (not shown). Where multiple brackets are interconnected, they may be connected with various spacing (typically 12-24 inches between each bracket) and may result in various overall lengths, depending on the intended use.

It should be understood, of course, that the foregoing relates to exemplary embodiments of the invention and that modifications may be made without departing from the spirit and scope of the invention as set forth in the following claims.

What is claimed is:

1. A method for securing an expansion joint board, comprising:

placing a plurality of expansion joint brackets along an area where the expansion joint board is to be placed, the expansion joint brackets comprising a base member; a nail hole on each end of the base member; first and second vertical support pieces; a first gusset running from the base member to the first vertical support piece; and a second gusset running from the base member to the second vertical support piece, wherein the first vertical support piece and the second vertical support piece form a channel adapted to receive an expansion joint board;

securing a nail through each nail hole of the base member;

placing the expansion joint board in position in the channels formed between the first and second vertical pieces of the plurality of expansion joint brackets; and optionally securing the expansion joint board to the expansion joint brackets with nails disposed through nail holes in each of the vertical support pieces.

2. The method of claim 1, further comprising disposing the expansion joint brackets with a spacing from about 12 to about 24 inches apart.

* * * * *